US005402910A

United States Patent [19]

Pilney

[11] Patent Number: 5,402,910

[45] Date of Patent: Apr. 4, 1995

[54] CONTAINER HAVING LADDER ATTACHABLE HANDLE

[76] Inventor: Craig Pilney, 7105 Eleanor Pl., Darien, Ill. 60561

[21] Appl. No.: 192,912

[22] Filed: Feb. 7, 1994

Related U.S. Application Data

[63] Continuation-in-part of Ser. No. 17,027, Feb. 12, 1993, abandoned.

[51] Int. Cl.[6] ..... B65D 25/32

[52] U.S. Cl. ..... 220/751; 220/756; 220/570

[58] Field of Search ..... 220/570, 751, 755, 756, 220/757, 760, 773, 658, 306

[56] References Cited

U.S. PATENT DOCUMENTS

| | | | |
|---|---|---|---|
| D. 202,134 | 8/1965 | Bryan . | |
| 733,984 | 7/1903 | Lucas | 220/570 |
| 973,564 | 10/1910 | Pritchard . | |
| 1,196,492 | 8/1916 | Sykes . | |
| 1,610,200 | 12/1926 | Campbell . | |
| 2,508,258 | 5/1950 | Heinrich | 220/751 |
| 2,908,468 | 10/1959 | Thomas | 220/751 |
| 2,988,767 | 6/1961 | Tretwold et al. . | |
| 3,292,815 | 12/1966 | Smith et al. | 220/751 |
| 3,391,698 | 7/1968 | Wiles . | |
| 3,593,951 | 7/1971 | Warner et al. | 220/570 |
| 3,630,251 | 12/1971 | Ross . | |
| 3,643,854 | 2/1972 | Holmes | 220/751 |
| 3,731,840 | 5/1973 | Beutler et al. | 220/570 |
| 4,205,411 | 6/1980 | Cupp et al. | 220/756 |
| 4,616,762 | 10/1986 | Alexander . | |
| 4,756,439 | 7/1988 | Perock . | |
| 5,052,581 | 10/1991 | Christ et al. | 220/570 |
| 5,201,439 | 4/1993 | Davies . | |
| 5,224,617 | 7/1993 | Gaudreault | 220/306 |

*Primary Examiner*—Stephen J. Castellano
*Attorney, Agent, or Firm*—Welsh & Katz, Ltd.

[57] ABSTRACT

A multiple-use utility container includes a rectangular receptacle having a substantially planar bottom wall and upstanding rectangular side and end walls defining an open upper end adapted to receive a lid thereon. The receptacle forms a leak proof receptacle and has a lateral width and transverse depth sufficient to receive one or more utility tools, including a paint roller. A generally U-shaped handle is pivotally connected to the upstanding end walls and has a substantially horizontal hanging bar enabling releasable attachment to a generally horizontal step of a stepladder or to a generally cylindrical rung of an extension ladder so that the receptacle is maintained in an upright position by gravity.

5 Claims, 2 Drawing Sheets

10
12
14
16
20
26
28a
28b
30a
30b
36
36a
38
38a
42
42a
44
44a
46
46a
46b
46c
48
50
52
56
56a
58
58a
60
62

CONTAINER HAVING LADDER ATTACHABLE HANDLE

BACKGROUND OF THE INVENTION

This is a continuation-in-part from Ser. No. 08/017,027, filed Feb. 12, 1993, which is incorporated herein by reference.

The present invention relates generally to containers, and more particularly to a novel improved container which finds particular application as a multiple-use utility container and which includes handle means facilitating attachment to a step of a stepladder or to a generally cylindrical rung of an extension type ladder so that the container maintains an optimum upright orientation preventing spillage.

It is a common practice when undertaking home repairs or construction projects, such as painting, drywall seaming, applying stucco compound and other similar activities, to utilize a container from which a material or product, or hand tools, can be conveniently removed for application or use. In working with relatively low viscosity flowable materials such as paints, stains or other liquid finishes, it is particularly important that the container maintain a relatively upright orientation so as not to inadvertently spill the flowable material. Gripping the handle of a paint can of the type having a conventional arcuate wire-like handle hinged to the can allows the can to maintain an upright position by gravity. However, this practice leaves only one hand free to manipulate the applicator or grasp a support. When working at heights where either a stepladder or a rung type extension ladder is necessary, holding such a paint can in one hand is not only tiring, but also prevents gripping of the ladder with one hand for safety while the other hand manipulates a paint brush or other applicator. Thus, a container having handle means facilitating attachment of the container to a step or rung of the ladder such that the container maintains an upright orientation yet may be readily removed would provide significant safety and convenience advantages over a utility container which can only be supported by hand or on a fixed relatively horizontal surface while products or tools are removed from or inserted into the container. The ability of the container to continually maintain a generally upright orientation when attached to a ladder is particularly desirable when moving the ladder with the container attached, thus preventing spillage with its attendant time consuming cleanup in the case of paints and the like.

SUMMARY OF THE INVENTION

Accordingly, a general object of the present invention is to provide a novel multiple-use utility container which enables independent support on a generally horizontal support surface or stable attachment by handle means to a generally horizontal step of a stepladder or to a generally cylindrical ladder rung with the container being continuously maintained in an upright orientation by gravity.

A more particular object of the present invention is to provide a novel multiple-use utility container which includes a rectangular open-top receptacle having a planar transverse bottom wall and upstanding side walls adapted to receive a lid on the upper edges in sealed relation, and wherein a pair of axially aligned hinge posts extend outwardly from opposite end walls and have the handle means pivotally connected thereto. The handle means includes a hand-grip portion which is offset from a pair of pivot arms that are pivotally connected to the hinge posts. The hand-grip portion enables attachment to a generally horizontal step of a stepladder to maintain the handle means in a horizontal position or suspension from a generally cylindrical rung of an extension ladder. In either mode of support, the receptacle maintains an upright orientation due to gravity.

A feature of the utility container in accordance with the invention lies in providing handle means which facilitates suspension of the rectangular receptacle from a ladder step or rung and further enables contact of the handle means with a ground surface or the like when the receptacle is freely supported thereon so that the operator may stabilize the container by engaging the handle means with his/her foot.

Further objects, features and advantages of the invention will become apparent from the following detailed description of the invention taken in conjunction with the accompanying drawings wherein like reference numerals designate like elements throughout the several views.

DETAILED DESCRIPTION

Figure 1:
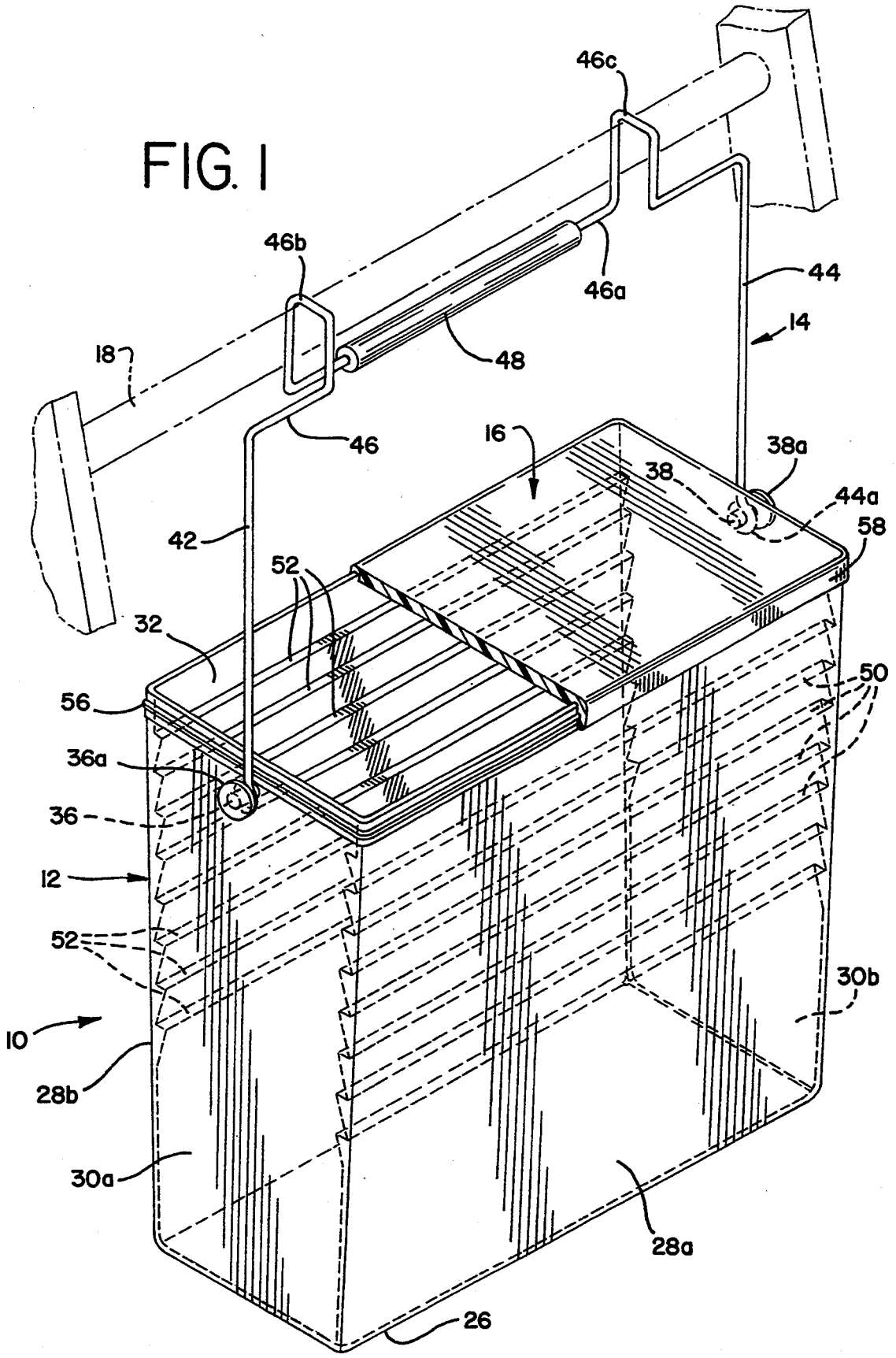
FIG. 1 is a perspective view of a multi-use utility container constructed in accordance with the present invention, a fragmentary portion of the lid being broken away for clarity.

Referring now to the drawings, and in particular to FIG. 1, a multi-use utility container constructed in accordance with the present invention is indicated generally at 10. Briefly, the container 10 includes a rectangular receptacle 12, handle means 14 pivotally connected to opposite end walls of the receptacle 12, and a releasable lid 16. The handle means 14 is adapted to facilitate releasable attachment of the utility container to a generally cylindrical rung of an extension-type ladder, indicated in phantom at 18 in FIG. 1 or to a generally horizontal step of a stepladder, such as indicated at 20 in FIG. 2, such that the receptacle maintains a substantially upright orientation due to gravity. The receptacle 12 is adapted to releasably receive the rectangular lid 16 thereon in sealing relation as will be more fully described below.

The receptacle 12 is preferably made of a unitary construction from a suitable plastic material which lends itself to injection molding or other manufacturing techniques. The receptacle has a substantially planar rectangular bottom wall 26, a pair of upstanding rectangular mutually opposed side walls **28*a* and 28*b* and a pair of mutually opposed upstanding end walls 30*a* and 30*b***. The upstanding rectangular side and end walls 28*a,b* and 30*b*, respectively, are mutually connected to each other to form four upstanding corners of the rectangular receptacle 12 and have lower marginal edges preferable formed integral with or otherwise suitably secured to peripheral marginal edges of the bottom wall 26 so as to form an upper open-ended receptacle suitable for containing fluids or flowable materials when in an upstanding or upright position as illustrated in FIG. 1. An upper open end 32 of the receptacle 12 is defined by upper coplanar marginal edges of the side walls 28*a,b* and end walls 30*a,b*.

Each of the upstanding end walls 30*a* and 30*b* has a hinge post or pivot stub shaft extending outwardly therefrom as indicated at 36 and 38, respectively. Each hinge post or pivot stub shaft 36 and 38 may be formed of a suitable plastic integral with its corresponding end wall 30*a* or 30*b* or may be formed as a metallic post or shaft suitably secured to the corresponding end wall. The hinge posts or pivot stub shafts 36 and 38 are axially aligned and secured to their corresponding upstanding end walls adjacent the upper marginal edges thereof intermediate the transverse widths of the end walls. Preferably each hinge post 36 and 38 has a circular disk formed on or otherwise suitably secured to its outer end as indicated at 36*a* and 38*a*, respectively. Alternatively, protective brackets could be secured to the end walls 30*a* and 30*b* to engage the outer ends of the respective hinge posts or pivot stub shafts.

The hinge posts 36 and 38 facilitate pivotal or hinged connection of the handle means 14 to the receptacle 12. To this end, the handle means 14 comprises a generally U-shaped handle which may be made from a suitable metallic wire or rod so as to form a pair of coplanar equal length parallel pivot arms 42 and 44 which are integrally interconnected at first ends to opposite ends of a hanging bar 46 disposed substantially parallel to the axis of the hinge posts 36 and 38. The arms 42 and 44 are connected at their ends opposite the hanging bar 46 to the corresponding hinge posts 36 and 38, as by circular loop ends 42*a* and 44*a* formed on the pivot arms to enable pivotable or hinged movement of the handle means 14 relative to the receptacle 12.

The hanging bar portion 46 of the handle means 14 includes a rectilinear portion 46*a* which is parallel to the hinge axis defined by the hinge posts 36 and 38 and is interconnected to the ends of the pivot arms opposite their loop ends through generally U-shaped portions 46*b* and 46*c* so that the bar portion 46*a* lies in a plane parallel to and spaced from the plane of the pivot arms 42 and 44. A tubular hand grip 48 is supported on the rectilinear portion 46*a* of the hanging bar to facilitate hand-lifting and carrying of the utility container 10.

Figures 2, 3, 4:
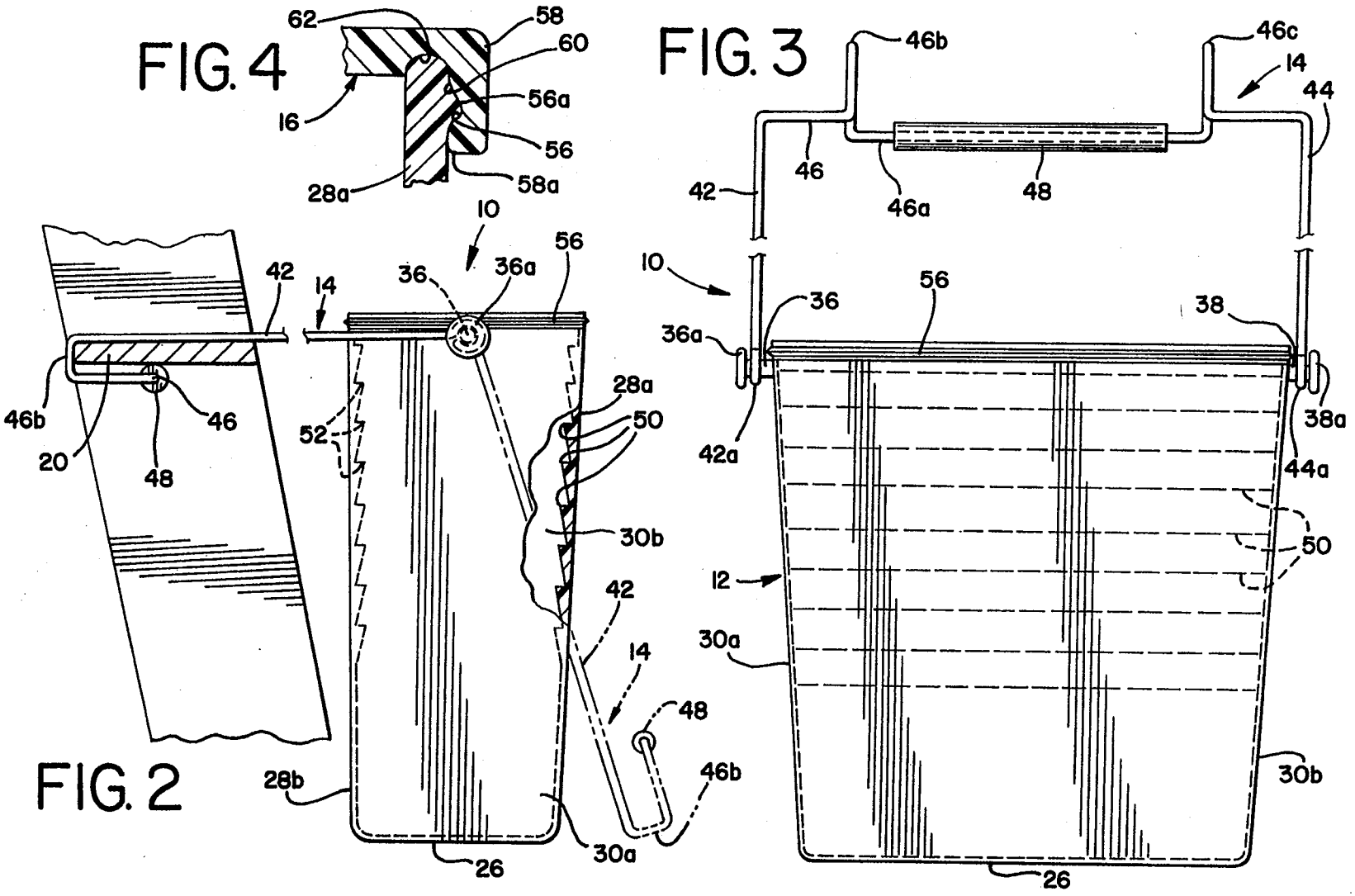
FIG. 2 is an end elevational view of the container of FIG. 1 but with the lid removed and the handle means mounted on a generally horizontal step of a stepladder, a portion of the receptacle being broken away for clarity.
FIG. 3 is a front elevational view of the utility container illustrated in FIG. 1 but with the lid removed.
FIG. 4 is a fragmentary sectional view, on an enlarged scale, illustrating the manner of attachment of the lid to the upper ends of the side and end walls of the receptacle.

With particular reference to FIGS. 1 and 2, the handle means 14 enables releasable gripping of an edge of a stepladder step, such as indicated at 20 in FIG. 2, by engaging or hooking the U-shaped portions 46*b* and 46*c* about a longitudinal edge of the step with the rectilinear portion 46*a* and associated hand grip 48 underlying the step and with the pivot arms 42 and 44 overlying the step and being supported in substantially horizontal relation. With the handle means 14 thus engaged with the step of a stepladder, the receptacle 12 is free to pivot about the looped ends 42*a* and 44*a* of the pivot arms and will establish an upright substantially vertical orientation due to gravity.

Alternatively, when utilizing the container 10 with an extension type ladder having generally cylindrical rungs, such as indicated at 18 in FIG. 1, the handle portion 46*a* and associated hand grip 48 may be readily releasably placed over the rung so that the rung is received within the U-shaped portions 46*b* and 46*c* of the handle. In this manner the receptacle is suspended and will maintain a substantially vertical upright position due to gravity and enable an operator to access the interior of the receptacle for removing tools therefrom or enabling insertion of a paint roller when paint or other liquid is disposed within the receptacle. It will be appreciated that depending on the incline of the ladder, the receptacle 12 may, when suspended from the rung 18, engage a lower rung so that the receptacle is not in a true vertical orientation.

The upstanding side walls 28*a* and 28*b* are preferably inclined outwardly as they extend upwardly from the bottom wall 26 so as to diverge relative to each other. In the illustrated embodiment, the side walls 28*a* and 28*b* are inclined outwardly to form included angles of approximately 5–10½ degrees from a plane perpendicular to the bottom wall 26. If desired, the end walls 30*a* and 30*b* may be similarly inclined outwardly relative to the bottom wall 26.

At least one, and preferably both, of the side walls 28*a* and 28*b* has ridge or rib means formed on its surface facing inwardly of the receptacle 12 so as to facilitate engagement with a paint roller or the like for squeezing excess paint from the roller as it is retracted from a pool of paint within the bottom of the receptacle. In the illustrated embodiment, such ridge means are formed on the inner surface of each of the side walls 28*a* and 28*b* and takes the form of a plurality of parallel transverse convex ridges as indicated at 50 and 52 for the respective side walls 28*a* and 28*b*. In the illustrated embodiment, the convex ridges or ribs have a generally saw tooth profile, but ribs or ridges of other convex profiles may also be utilized.

Preferably, the upper marginal edges of the side walls 28*a* and 28*b* and end walls 30*a* and 30*b* have an outwardly extending lip formed thereon, such as indicated at 56 in FIG. 4. The lip 56 extends about the full periphery of the opening 32 slightly below the uppermost planar edges of the side and end walls. The lip 56 preferably has an outwardly and downwardly inclined ramp or cam surface 56*a* which facilitates outward deformation of an annular depending retaining wall 58 formed peripherally of the lid 16. The peripheral wall 58 has a continuous recess 60 having a transverse profile similar to the lip 56 for sealing relation therewith. The peripheral wall 58 on the lid preferably has a rounded or chamfered inner edge surface 58*a* to facilitate a camming action with the ramp surface 56*a* when the lid is pressed downwardly over the upper edges of the side and end walls of the receptacle 12 to releasably retain the lid in assembled sealed relation on the receptacle. The lid 16 and associated peripheral wall 58 are preferably made of a plastic material and have sufficient resiliency to facilitate repeated assembly onto the upper end of the receptacle in sealing relation therewith. The lid 16 also has a peripheral recess 62 formed therein to receive the upper marginal edges of the side and end walls of the receptacle.

In addition to facilitating releasable attachment of the utility container 10 to a generally cylindrical rung of an extension type ladder or to a generally horizontal step of a stepladder, as illustrated in FIGS. 1 and 2, the handle means 14 also facilitates stabilizing of the receptacle 12 when supported on its bottom wall 26 on a fixed horizontal support or ground surface. To this end, the pivot arms 42 and 44 of the handle means 14 are made of sufficient length that the generally U-shaped portions **46*b* and 46*c* will engage the ground or a support surface upon which the receptacle 12 is supported on its bottom wall 26, such as indicated in phantom in FIG. 2. In this position, an operator may engage the hand grip 48** with his/her foot to stabilize the receptacle in an upright position, as when pouring paint or other flowable substance into the receptacle preparatory to attachment to a ladder at an elevated position.

While a preferred embodiment of the multi-use utility container in accordance with the present invention has been illustrated and described, it will be understood to those skilled in the art that changes and modifications may be made therein without departing from the invention in its broader aspects. Various features of the invention are defined in the following claims.

What is claimed is:

1. A utility container comprising a rectangular receptacle having a substantially planar rectangular bottom wall and upstanding rectangular side and end walls mutually connected to each other and connected at lower marginal edges to marginal side and end edges of said bottom wall so as to form a leak proof receptacle when in an upright position, said upstanding rectangular side walls being mutually opposite each other and inclined outwardly as they extend upwardly from said bottom wall, said receptacle having a lateral width and transverse depth sufficient to receive one or more utility tools such as a paint roller, at least one of said side walls having transverse ridges formed on its inwardly facing surface to facilitate engagement by and rotation of a rotatable paint roller for squeezing excess paint from the roller when the container is used as a paint receptacle, said side and end walls having coplanar upper marginal edges defining an upper open end of said receptacle, a retaining lip formed adjacent said upper marginal edges of said side and end walls so as to extend circumferentially of said open end and facilitate releasably attachment of a lid to said receptacle, a hinge post secured to and extending outwardly from each of said upstanding end walls generally adjacent the upper edge thereof such that said hinge posts are axially aligned and define a hinge axis disposed generally centrally of the transverse width of said end walls, and a generally U-shaped handle including a pair of substantially coplanar pivot arms having first ends freely pivotally mounted on said hinge posts, and having second ends connected to opposite ends of a hanging bar through U-shaped portions of the handle so that the hanging bar is parallel to said hinge axis and lies in a plane parallel to and spaced from the plane of said coplanar pivot arms, said hanging bar enabling attachment to a generally horizontal step of a stepladder so that said pivot arms engage an upper surface of the step and are disposed substantially horizontally to support the receptacle in a freely hanging upright position by gravity, said hanging bar also enabling attachment to a generally cylindrical ladder rung so that said pivot arms hang downwardly with said receptacle freely biased to an upright position by gravity.

2. A utility container as defined in claim 1 wherein each of said side walls has a plurality of transverse ridges formed on its inwardly facing surface.

3. A utility container as defined in claim 2 wherein said ridges comprise parallel transverse convex ridges.

4. A utility container as defined in claim 1 including bracket means secured to the outer surfaces of said end walls to overlie the ends of said hinge posts.

5. A utility container as defined in claim 1 wherein said rectangular receptacle has a major axis dimension of at least seven inches and a minor axis of at least three inches, considered substantially in the plane of said bottom wall.

* * * * *